US011846279B2

(12) United States Patent
Pham

(10) Patent No.: US 11,846,279 B2
(45) Date of Patent: Dec. 19, 2023

(54) ACCURATE VOLUME DISPENSING USING PUMP AND FLOW SENSOR

(71) Applicant: Masterflex, LLC, Radnor, PA (US)

(72) Inventor: Phuong Le Pham, Mount Prospect, IL (US)

(73) Assignee: Masterflex, LLC, Radnor, PA (US)

( * ) Notice: Subject to any disclaimer, the term of this patent is extended or adjusted under 35 U.S.C. 154(b) by 0 days.

(21) Appl. No.: 17/162,908

(22) Filed: Jan. 29, 2021

(65) Prior Publication Data

US 2022/0243719 A1 Aug. 4, 2022

(51) Int. Cl.
*F04B 49/06* (2006.01)
*F04B 49/10* (2006.01)
(Continued)

(52) U.S. Cl.
CPC ..... *F04B 49/065* (2013.01); *F04B 43/08* (2013.01); *F04B 43/09* (2013.01); *F04B 49/103* (2013.01);
(Continued)

(58) Field of Classification Search
CPC ..... F04B 43/08; F04B 43/09; F04B 49/20; F04B 49/065; F04B 43/12; F04B 43/1253;
(Continued)

(56) References Cited

U.S. PATENT DOCUMENTS 3,990,444 A 11/1976 Vial
4,643,649 A * 2/1987 Schmid ..... F04B 49/065 417/45
(Continued)

FOREIGN PATENT DOCUMENTS

CN 101274113 A 10/2008
CN 105487561 A 4/2016
(Continued)

OTHER PUBLICATIONS

European Extended Search Report for related EP Application No. 22153769.9 dated May 19, 22, 12 pages.
(Continued)

*Primary Examiner* — Philip E Stimpert
(74) *Attorney, Agent, or Firm* — Faegre Drinker Biddle & Reath LLP

(57) ABSTRACT

Aspects are provided for positive displacement pumps and methods and systems for controlling such positive displacement pumps for accurate volume dispensing. The pump may run a calibration procedure to determine a mapping between a pump speed and a flow rate for a current configuration of the positive displacement pump, a tubing size, and a fluid characteristic. A pump controller may determine a pump motion profile based on the mapping. The pump motion profile includes an acceleration phase, a constant speed phase, and a deceleration phase such that a total volume pumped according to the pump motion profile and the mapping is equal to a target volume. The pump controller may determine an adjustment to the pump motion profile based on a constant flow rate measured during operation. The pump controller may decelerate the positive displacement pump according to the adjusted pump motion profile until the target volume is dispensed.

21 Claims, 8 Drawing Sheets

(51) Int. Cl.
*F04B 43/08* (2006.01)
*F04B 43/09* (2006.01)

(52) U.S. Cl.
CPC .... *F04B 49/106* (2013.01); *F04B 2201/1201* (2013.01); *F04B 2205/09* (2013.01)

(58) Field of Classification Search
CPC ..... F04B 43/1261; F04B 45/00; F04B 45/06; F04B 45/065
See application file for complete search history.

(56) References Cited

U.S. PATENT DOCUMENTS

| | | | | |
|---|---|---|---|---|
| 4,715,786 | A | 12/1987 | Wolff et al. | |
| 4,981,467 | A | 1/1991 | Bobo, Jr. et al. | |
| 5,716,194 | A | 2/1998 | Butterfield et al. | |
| 5,915,932 | A | 6/1999 | Nabity et al. | |
| 9,119,917 | B2 | 9/2015 | Blomquist | |
| 9,283,332 | B2 | 3/2016 | Unverdorben | |
| 9,408,968 | B2 | 8/2016 | Browne et al. | |
| 10,112,009 | B2 | 10/2018 | Dudar et al. | |
| 10,632,264 | B2 | 4/2020 | Toshima | |
| 2002/0150476 | A1 | 10/2002 | Lucke et al. | |
| 2005/0161469 | A1* | 7/2005 | Roady | B67D 1/0012 222/1 |
| 2005/0256388 | A1 | 11/2005 | Susi | |
| 2007/0038191 | A1 | 2/2007 | Burbank et al. | |
| 2007/0060786 | A1 | 3/2007 | Gura et al. | |
| 2007/0060874 | A1 | 3/2007 | Nesbitt et al. | |
| 2008/0092961 | A1 | 4/2008 | Bair et al. | |
| 2008/0145249 | A1 | 6/2008 | Smisson et al. | |
| 2009/0075129 | A1 | 3/2009 | Sparks et al. | |
| 2010/0135824 | A1* | 6/2010 | Ickinger | F04B 49/06 417/1 |
| 2010/0209263 | A1 | 8/2010 | Mazur | |
| 2010/0292635 | A1 | 11/2010 | Sundar | |
| 2010/0324465 | A1 | 12/2010 | Vinci et al. | |
| 2012/0308409 | A1* | 12/2012 | Levine | F04B 23/02 417/274 |
| 2013/0336814 | A1 | 12/2013 | Kamen et al. | |
| 2014/0171869 | A1 | 6/2014 | Zhang | |
| 2016/0045400 | A1 | 2/2016 | Hudson | |
| 2016/0146649 | A1 | 5/2016 | Evans et al. | |
| 2016/0158437 | A1 | 6/2016 | Biasi et al. | |
| 2016/0265519 | A1 | 9/2016 | Igarashi | |
| 2016/0312803 | A1 | 10/2016 | Cox et al. | |
| 2018/0074525 | A1 | 3/2018 | Imai et al. | |
| 2018/0117241 | A1 | 5/2018 | Amborn et al. | |
| 2019/0070074 | A1 | 3/2019 | Biehl et al. | |
| 2019/0192760 | A1 | 6/2019 | Gorbachinsky | |

FOREIGN PATENT DOCUMENTS

| | | | |
|---|---|---|---|
| CN | 108159531 | A | 6/2018 |
| CN | 108355197 | A | 8/2018 |
| DE | 19525926 | C1 | 11/1996 |
| EP | 2917581 | A1 | 9/2015 |
| JP | WO2014/049656 | A1 | 8/2016 |
| JP | 6478815 | B2 | 3/2019 |
| WO | WO2008/142741 | A1 | 11/2008 |
| WO | WO2015/166051 | A1 | 11/2015 |
| WO | WO2019/085155 | A1 | 5/2019 |
| WO | WO2019/141489 | A1 | 7/2019 |

OTHER PUBLICATIONS

S. Ozeri, et al. "Ultrasonic Air Bubble Detection Employing Signal Processing Techniques", IEEE ISIE 2006, Jul. 9-12, 2006. (6 Pages Total).

SONOTEC GmbH, SONOTEC Ultrasonic Solutions, SONOCHECK ABD Air Bubble Sensors & Detectors Medical Devices for Medical applications with very high safety requirements, SONOCKECK® ABD05 | ABD07 | ABD0—Air bubble sensors for use in medical technologies, Retrieved from Url: https://www.sonotecusa.com/products/non-invasive-fluid-monitoring/air-bubble-detection/sonocheck-abd-medtech/, (Accessed Jul. 27, 2020), (5 Pages Total).

* cited by examiner

ACCURATE VOLUME DISPENSING USING PUMP AND FLOW SENSOR

INTRODUCTION

Aspects of the present disclosure generally relate to positive displacement pumps and systems for controlling such pumps.

BACKGROUND

Fluid handling apparatuses such as positive displacement pumps are used in various environments to supply fluids at set rates. Positive displacement pumps are often used due to their precision and durability. For example, positive displacement pumps may operate unattended for continuous laboratory or manufacturing processes.

Although positive displacement pumps can operate for long periods of time without malfunctioning, errors can occur. For example, a positive displacement pump may utilize tubing that changes during operation of the positive displacement pump, for example, due to gradual wear changing tubing properties. The changes in the tubing may affect calibrated settings of the positive displacement pump.

Accordingly, there remains an unmet need in the related art for positive displacement pumps and systems and methods of control thereof that allow greater accuracy for volume dispensing.

SUMMARY

The following presents a simplified summary of one or more aspects of the present disclosure in order to provide a basic understanding of such aspects. This summary is not an extensive overview of all contemplated aspects, and is intended to neither identify key or critical elements of all aspects, nor delineate the scope of any or all aspects. Its purpose is to present some concepts of one or more aspects in a simplified form as a prelude to the more detailed description that is presented later.

In an aspect, the present disclosure provides a method of controlling a positive displacement pump. The method may include running a calibration procedure to determine a mapping between a pump speed and a flow rate for a current configuration of the positive displacement pump, a tubing size, and a fluid characteristic. The method may include determining a pump motion profile based on the mapping, wherein the pump motion profile includes an acceleration phase, a constant speed phase, and a deceleration phase such that a total volume pumped according to the pump motion profile and the mapping is equal to a target volume. The method may include running the positive displacement pump according to the pump motion profile. The method may include measuring a constant flow rate at a downstream flow rate sensor while the pump operates at a first constant speed during the constant speed phase. The method may include determining an adjustment to the pump motion profile based on the constant flow rate, the adjustment including a second constant speed. The method may include running the positive displacement pump at the second constant speed. The method may include decelerating the positive displacement pump according to the adjusted pump motion profile until the target volume is dispensed.

In an aspect, the present disclosure provides a system of controlling a positive displacement pump. The system may include the positive displacement pump configured to pump a fluid through a tube. The system may include a flow sensor configured to measure a flow rate of the fluid in the tube downstream from the positive displacement pump. The system may include a pump controller configured to run a calibration procedure to determine a mapping between a pump speed and a flow rate for a current configuration of the positive displacement pump, a tubing size, and a fluid characteristic. The pump controller may be configured to determine a pump motion profile based on the mapping, wherein the pump motion profile includes an acceleration phase, a constant speed phase, and a deceleration phase such that a total volume pumped according to the pump motion profile and the mapping is equal to a target volume. The pump controller may be configured to run the positive displacement pump according to the pump motion profile. The pump controller may be configured to measure a constant flow rate at a downstream flow rate sensor while the pump operates at a first constant speed during the constant speed phase. The pump controller may be configured to determine an adjustment to the pump motion profile based on the constant flow rate, the adjustment including a second constant speed. The pump controller may be configured to run the positive displacement pump at the second constant speed. The pump controller may be configured to decelerate the positive displacement pump according to the adjusted pump motion profile until the target volume is dispensed.

In an aspect, the present disclosure provides a positive displacement pump. The positive displacement pump may include a pumphead configured to pump a fluid through a tube. The positive displacement pump may include a flow sensor configured to measure a flow rate of the fluid in the tube downstream from the pumphead. The positive displacement pump may include a pump controller configured to run a calibration procedure to determine a mapping between a pump speed and a flow rate for a current configuration of the positive displacement pump, a tubing size, and a fluid characteristic. The pump controller may be configured to determine a pump motion profile based on the mapping, wherein the pump motion profile includes an acceleration phase, a constant speed phase, and a deceleration phase such that a total volume pumped according to the pump motion profile and the mapping is equal to a target volume. The pump controller may be configured to run the positive displacement pump according to the pump motion profile. The pump controller may be configured to measure a constant flow rate at a downstream flow rate sensor while the pump operates at a first constant speed during the constant speed phase. The pump controller may be configured to determine an adjustment to the pump motion profile based on the constant flow rate, the adjustment including a second constant speed. The pump controller may be configured to run the positive displacement pump at the second constant speed. The pump controller may be configured to decelerate the positive displacement pump according to the adjusted pump motion profile until the target volume is dispensed.

These and other aspects of the present disclosure will become more fully understood upon a review of the detailed description, which follows.

DETAILED DESCRIPTION

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known components are shown in block diagram form in order to avoid obscuring such concepts.

In an aspect, the disclosure provides for a positive displacement pump with a flow sensor and methods for controlling such a positive displacement pump to quickly and accurately dispense a set volume of fluid.

A flow sensor may provide a measurement of a flow rate through tubing downstream from the positive displacement pump. Conventional control techniques (e.g., proportional-integral-derivative (PID) controllers) may have difficulty in controlling a positive displacement pump to dispense a set volume of fluid for several reasons. First, there may be latency between changes in the motor speed and changes in the detected flow rate. Second, a positive displacement pump may generate pulses in the flow rate. Given these factors, the total pumping time for a set volume may be too short for the flow rate to converge such that a PID controller can accurately stop the pump at the desired volume. Accordingly, there is a need for alternative techniques for controlling a pump based on a flow sensor to accurately dispense a volume of fluid.

In an aspect, the present disclosure provides a control method that drives the pump according to a pump motion profile including an acceleration phase, a constant speed phase, and a deceleration phase. The pump motion profile may be generated based on a calibrated mapping between pump speed and flow rate to dispense a total volume equal to a target volume. The acceleration phase may quickly bring the pump close to a maximum operation speed (e.g., 95%). The constant speed phase may include a single adjustment to an otherwise constant flow rate. The deceleration phase may include a constant portion with a flow rate based on a target precision. Accordingly, the pump may dispense a majority of the target volume at a high rate during the constant speed phase and precisely control the final volume. Therefore, the disclosed techniques may provide for faster and/or more accurate dispensing of a volume of fluid.

Figure 1A:
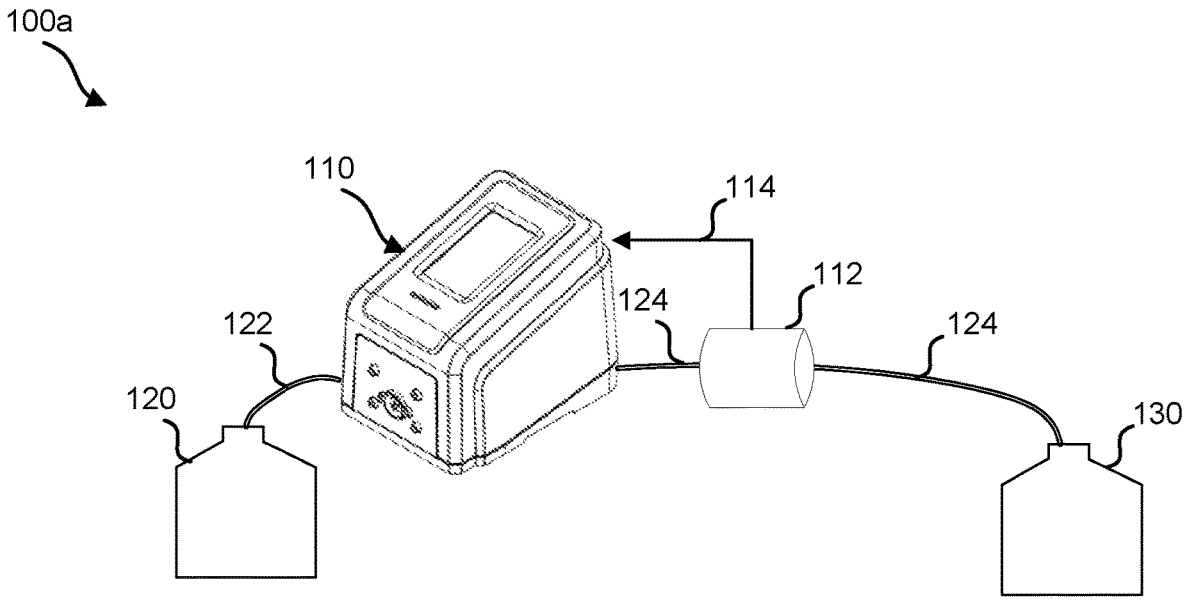
FIG. 1A is schematic diagram of an example operating environment for a positive displacement pump and flow sensor, according to an aspect of the disclosure.

FIG. 1A is a representative schematic diagram of a first example operating environment 100*a* for a positive displacement pump 110. The operating environment 100*a* may include the positive displacement pump 110, a fluid source 120, a fluid destination 130, and a flow sensor 112. The positive displacement pump 110 may pump fluid from the fluid source 120 to the fluid destination 130 via tubing, which may include an inlet tube 122 and an outlet tube 124. A flow sensor 112 may be located along the outlet tube 124. The flow sensor 112 may measure a flow rate in the outlet tube 124 and provide the flow rate to the positive displacement pump 110 via a connection 114. The connection 114 may be wired or wireless. For example, the connection 114 may include a serial bus, Ethernet, or a Wi-Fi connection. The positive displacement pump 110 may include a pump controller that controls a motor of the positive displacement pump 110 based on the flow rate. In particular, the positive displacement pump 110 may be controlled to accurately and precisely dispense a target volume of fluid to the fluid destination 130.

Figure 1B:
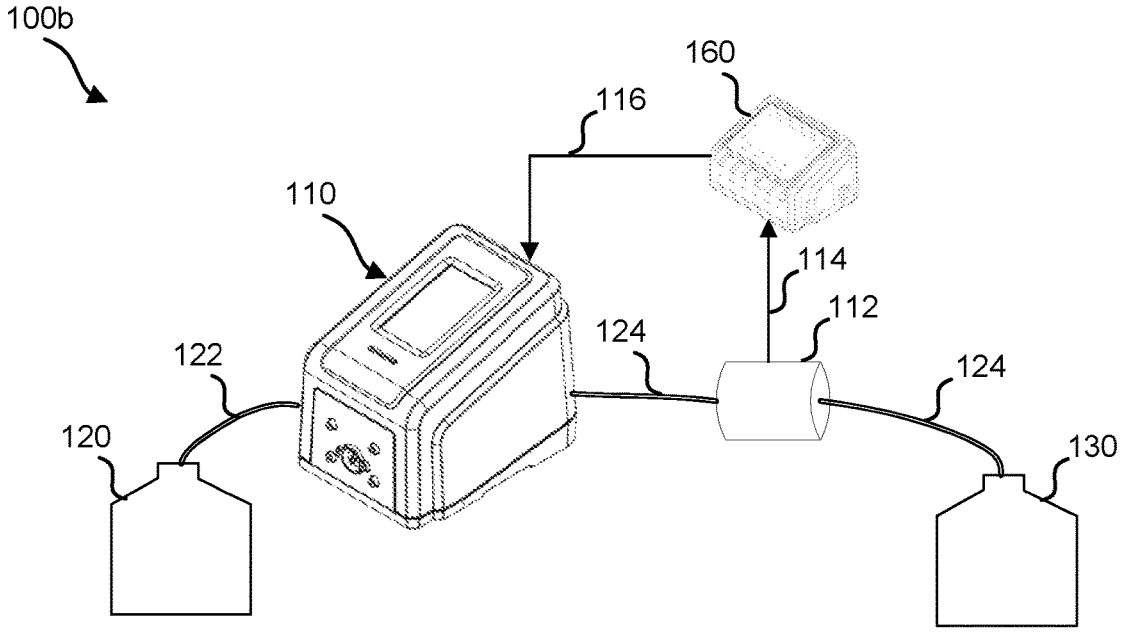
FIG. 1B is schematic diagram of an example operating environment for a positive displacement pump, external pump controller, and flow sensor, according to an aspect of the disclosure.

FIG. 1B is a representative schematic diagram of a second operating environment 100*b* for a positive displacement pump 110. The operating environment 100*b* may include the positive displacement pump 110, an external pump controller 160, the fluid source 120, the fluid destination 130, and the flow sensor 112. The positive displacement pump 110 may pump fluid from the fluid source 120 to the fluid destination 130 via tubing, which may include the inlet tube 122 and the outlet tube 124. The flow sensor 112 may be located along the outlet tube 124. The flow sensor 112 may measure a flow rate in the outlet tube 124 and provide the flow rate to the pump controller 160 via the connection 114. The connection 114 may be wired or wireless. For example, the connection 114 may include a serial bus, Ethernet, or a Wi-Fi connection. The pump controller 160 may control a motor of the positive displacement pump 110 based on the flow rate. For example, the flow controller may transmit a control signal via a connection 116, which may also be wired or wireless. In particular, the positive displacement pump 110 may be controlled to accurately and precisely dispense a target volume of fluid to the fluid destination 130.

The positive displacement pump 110 may be a positive displacement pump including the communications hardware (e.g., network interface) and software described herein for providing control of the positive displacement pump 110. As discussed above, the positive displacement pump 110 may be include a pump controller or may be controlled by an external pump controller 160.

Figure 2:
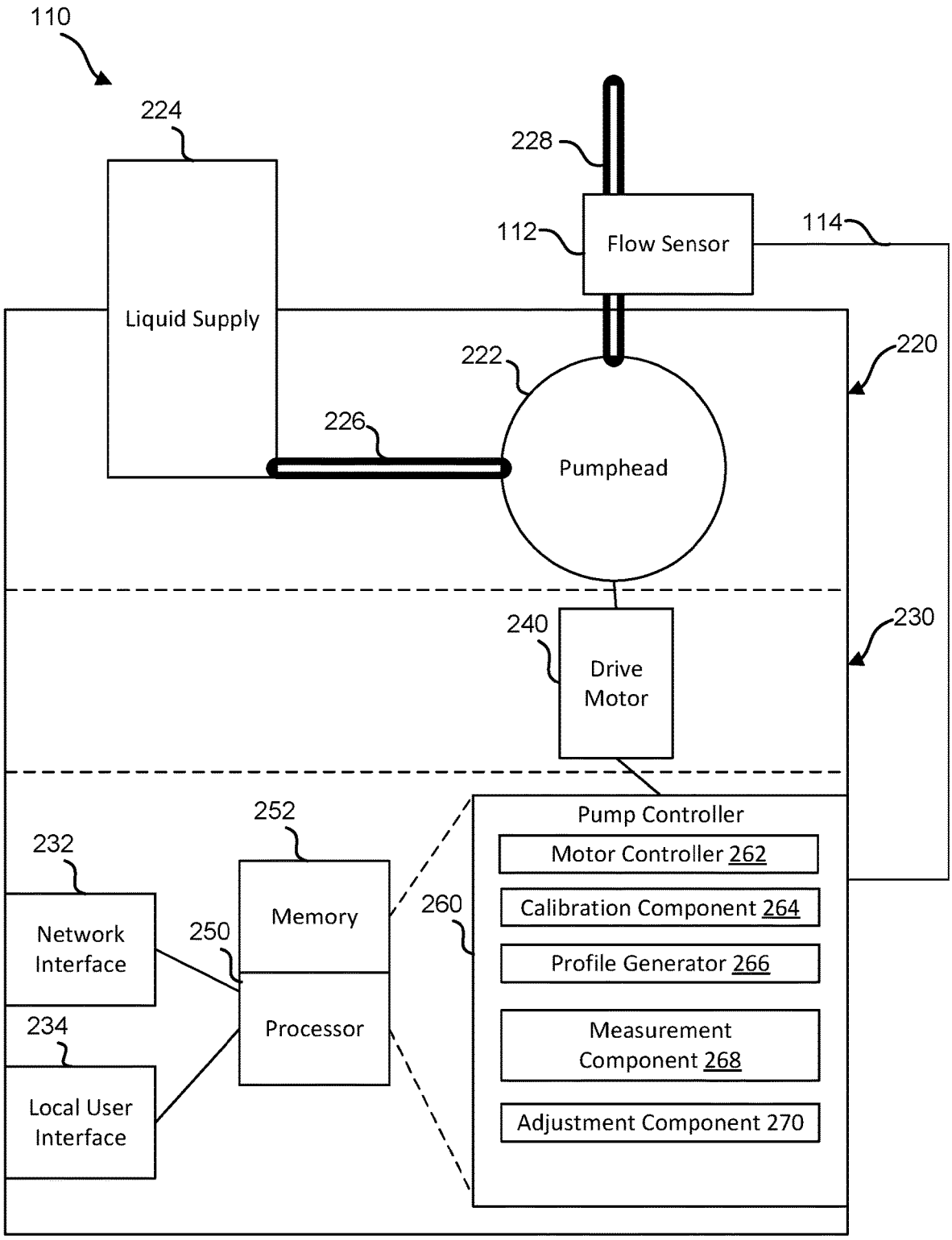
FIG. 2 is schematic diagram of an example positive displacement pump and flow sensor, according to an aspect of the disclosure.

FIG. 2 is a representative schematic diagram of an example positive displacement pump 110 usable in accordance with aspects of the present disclosure. The term "positive displacement pump" as used herein describes a category of fluid pumps that trap a fixed amount of fluid and force the trapped fluid to a discharge pipe. Positive displacement pumps are conventionally used in processes that require precise measurement or dosing of fluid. Positive displacement pumps may be driven by an electric motor under the control of a controller (e.g., electronic control unit (ECU) and/or other processor) that moves fluid at a desired rate. In an aspect, a positive displacement pump may include a detachable pumphead that includes a casing and fluid contacting components of the positive displacement pump. The pumphead may be driven by the motor via a magnetic coupling, for example. The positive displacement pump may be fitted with a different pumphead, depending on the desired operation. For example, in an aspect, a positive displacement pump may include a housing including the drive motor, controller, and user interfaces, and a detachable pumphead may be fitted in or on the housing. The selection of different pumpheads may configure the positive displacement pump 110 as, for example, one of a peristaltic pump, gear pump, or diaphragm pump.

The positive displacement pump 110 may include a wet end 220 and a case 230. The wet end 220 may include fluid handling components including a pumphead 222, a liquid supply 224, an inlet tube 226, and an outlet tube 228. The wet end 220 may be detachable from the case 230 to allow replacement or substitution of the wet end 220. For example, different pumpheads 222 may be selected for use in pumping different fluids.

The pumphead 222 may include a mechanism for pumping fluid. In an aspect, the positive displacement pump 110 may use a pumphead that allows precise monitoring of the fluid being pumped (e.g., volume pumped). Example pumpheads may include a peristaltic pumphead, a quaternary diaphragm pumphead, and/or a gear pumphead. The pumphead 222 may be connected to a liquid supply 224 via an inlet tube 226. The pumphead 222 may pump the fluid to the outlet tube 228. In an aspect, for example, using a peristaltic pump, the inlet tube 226 and the outlet tube 228 may be or include a continuous tube extending through the pumphead 222.

The case 230 may include electronic components of the positive displacement pump 110. For example, the case 230 may include a network interface 232, a local user interface 234, a drive motor 240, a processor 250, and a memory 252. Further, the memory 252 may store instructions executable by the processor 250 for implementing a pump controller 260, which may include a motor controller 262, a calibration component 264, a profile generator 266, a measurement component 268, and an adjustment component 270.

The network interface 232 may include a wired or wireless network interface for transmitting and receiving data packets. In an aspect, the network interface 232, for example, may utilize transmission control protocol/Internet protocol (TCP/IP) packets that may carry commands, parameters, or data. The network interface 232 may forward commands to the processor 250 for processing by the pump controller 260. Conversely, the network interface 232 may receive data generated by the pump controller 260 from the processor 250 and transmit the data, for example, to an external pump controller 160.

The local user interface 234 may include any suitable controls provided on the positive displacement pump 110 for controlling the positive displacement pump 110. In an aspect, the local user interface 234 may include a display screen that presents menus for selecting commands (e.g., set target volume). In another aspect, the local user interface 234 may include dedicated buttons and/or other selection features that perform specific commands. For example, the local user interface 234 may include a button for selection to start/stop pumping. The local user interface 234 may generate commands to the processor 250 for processing by the pump controller 260. In some implementations, the positive displacement pump 110 may operate in a remote mode in which the local user interface 234 is at least partially disabled to prevent local input.

The drive motor 240 may be or include an electric motor that provides a force for pumping the fluid. In an aspect, the drive motor 240 may be magnetically coupled to the pumphead 222 to drive the pumphead 222. The drive motor 240 may be controlled by the pump controller 260. For example, the pump controller 260 may generate a control signal indicating a speed and direction of the drive motor 240 based on received commands.

The processor 250 may include one or more processors for executing instructions. An example of processor 250 may include, but is not limited to, any suitable processor specially programmed as described herein, including a controller, microcontroller, application specific integrated circuit (ASIC), field programmable gate array (FPGA), system on chip (SoC), or other programmable logic or state machine. The processor 250 may include other processing components, such as an arithmetic logic unit (ALU), registers, and a control unit. The processor 250 may include multiple cores and may be able to process different sets of instructions and/or data concurrently using the multiple cores to execute multiple threads, for example.

Memory 252 may be configured for storing data and/or computer-executable instructions defining and/or associated with the pump controller 260, and processor 250 may execute such instructions with regard to operation of the pump controller 260. Memory 252 may represent one or more hardware memory devices accessible to processor 250. An example of memory 252 can include, but is not limited to, a type of memory usable by a computer, such as random access memory (RAM), read only memory (ROM), tapes, magnetic discs, optical discs, volatile memory, non-volatile memory, and any combination thereof. Memory 252 may store local versions of a pump controller application being executed by processor 250, for example.

The pump controller 260 may control operation of the positive displacement pump 110 based on commands received from either the network interface 232 or the local user interface 234, for example. The pump controller 260 may include a motor controller 262 for controlling operation of the drive motor 240, a calibration component 264 for performing a calibration operation to determine a mapping between pump speed and flow rate, a profile generator 266 for generating a pump motion profile for dispensing a target volume, a measurement component 268 for performing measurements of flow rate and/or pumped volume, and an adjustment component 270 for adjusting the pump motion profile.

Figure 3:
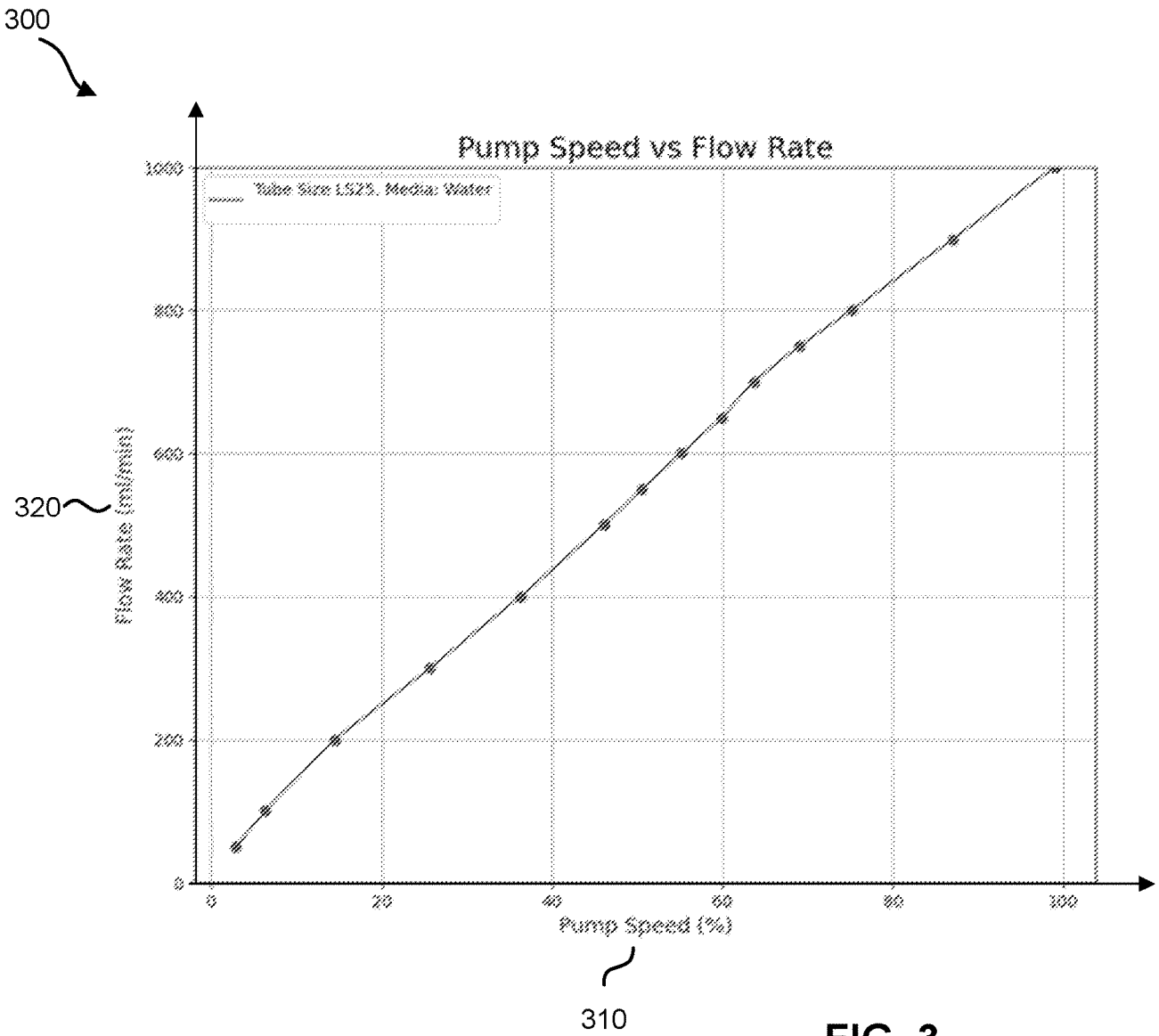
FIG. 3 is an example of a mapping between pump speed and flow rate, according to an aspect of the disclosure.

FIG. 3 is a diagram of an example mapping 300 from a pump speed 310 to a flow rate 320. The pump speed 310 may be expressed as a percentage of a maximum pump speed. In some implementations, the pump speed 310 may be expressed as a related value such as revolutions per minute (RPM), control signal input value, or input voltage. The flow rate may be expressed as a volume of fluid per unit of time (e.g., milliliters (mL)/minute (min)). The mapping 300 may be generated by the calibration component 264 by performing a calibration procedure. For example, the calibration procedure may include setting the pump speed at various levels and measuring a constant flow rate at the pump speed. The mapping 300 may be expected to be generally linear with some variance due to tubing characteristics (e.g., diameter, material, flexibility) and fluid characteristics (e.g., viscosity). Values that are not specifically calibrated may be interpolated from the measured values. In an aspect, the tubing characteristics and/or fluid characteristics may change over time. The control techniques disclosed herein may provide adaptation to the changing characteristics in order to improve accuracy and precision of a total volume of fluid pumped.

Figure 4:
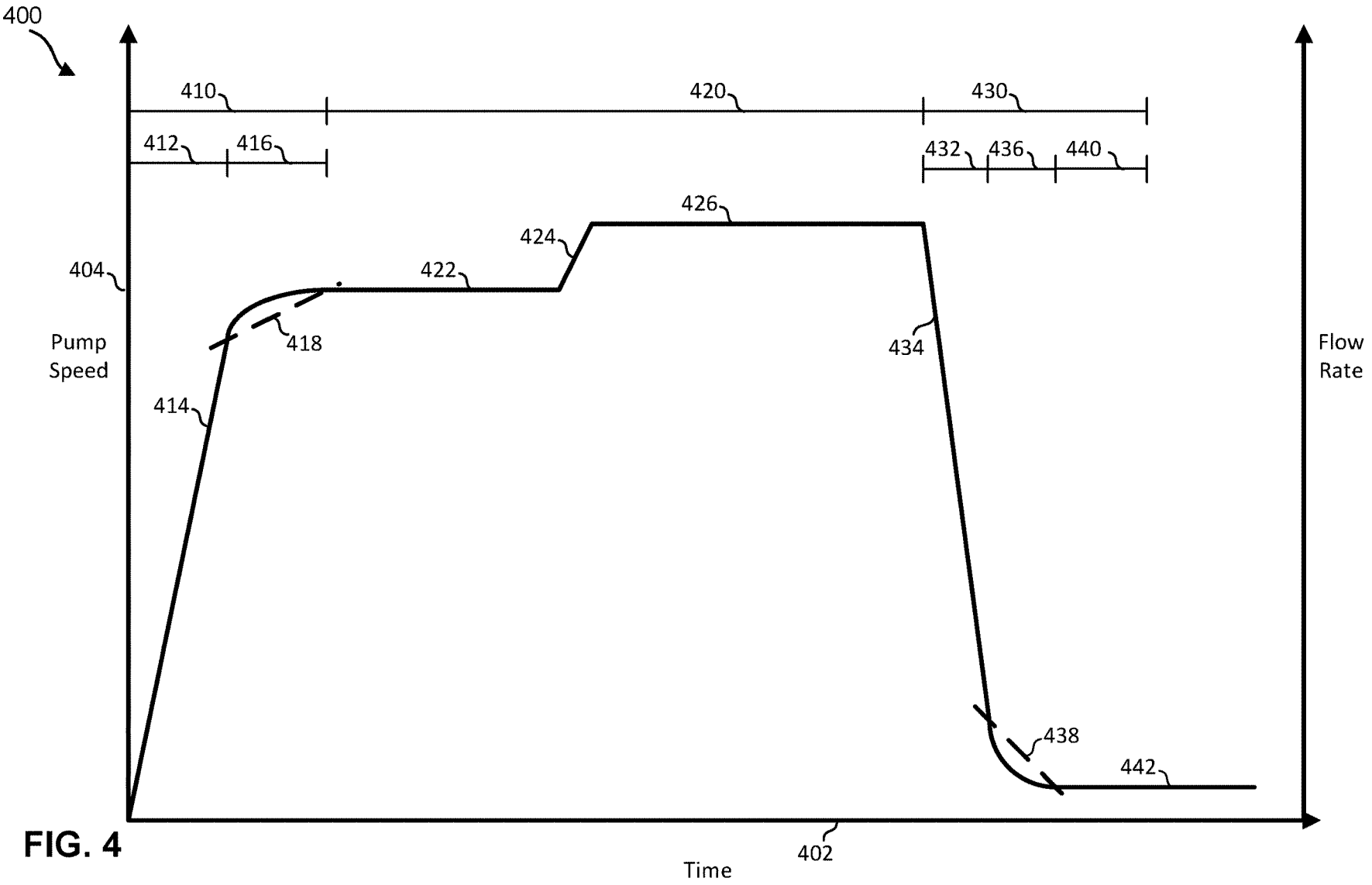
FIG. 4 is a diagram of an example pump motion profile, according to an aspect of the disclosure.

FIG. 4 is a diagram of an example pump motion profile 400. The pump motion profile 400 may indicate a pump speed 404 at which to operate the positive displacement pump 110 over a period of time 402 to dispense a target volume of fluid. The pump motion profile 400 may include an acceleration phase 410, a constant speed phase 420, and a deceleration phase 430. During the acceleration phase 410, the speed of the pump motor may increase. The acceleration phase may include a rapid acceleration portion 412 and a break portion 416. During the rapid acceleration portion 412 the pump speed may increase as quickly as possible (e.g., at a rate 414) toward a target speed near a maximum speed (e.g., 95%) of the pump 110. The target speed may be based on a target flow rate according to the mapping 300. During the break portion 416, the pump speed may increase at a second acceleration rate 418 that is slower than the first acceleration rate 414 in order to prevent a pump speed or flow rate from overshooting the target.

During the constant speed phase 420, the pump 110 may operate at the first constant speed 422. In an aspect, the constant speed phase 420 may include a single adjustment 424, where the target speed changes to a second constant speed 426. The adjustment 424 may be based on a measurement of the flow sensor 112 during the constant speed phase 420. The adjustment 424 may allow adaptation to any deviation of the flow rate from the mapping 300. For example, the adjustment 424 may include selecting the second target speed 426 such that a total volume dispensed during the constant speed phase 420 is equal to a target volume for the constant speed phase 420 according to the pump motion profile 400.

The deceleration phase 430 may include a rapid deceleration portion 432, a break portion 436, and a constant speed portion 440. During the rapid deceleration portion 432, the pump speed may decrease as quickly as possible from the target speed 426 toward a constant speed 442 (e.g., at a rate 434). During the break portion 436, the pump speed may decrease at a slower rate 438 in order not to overshoot the constant speed 442. The constant speed 442 may be selected based on a target precision. For example, a volume of fluid pumped when the pump is moved from the constant speed 442 to zero speed may be less than the target precision. Accordingly, during the constant portion 440, the pump 110 may be run at the constant speed 442 until the target volume is reached, then the pump 110 may be stopped such that the total volume is within the target precision of the target volume.

Figure 5:
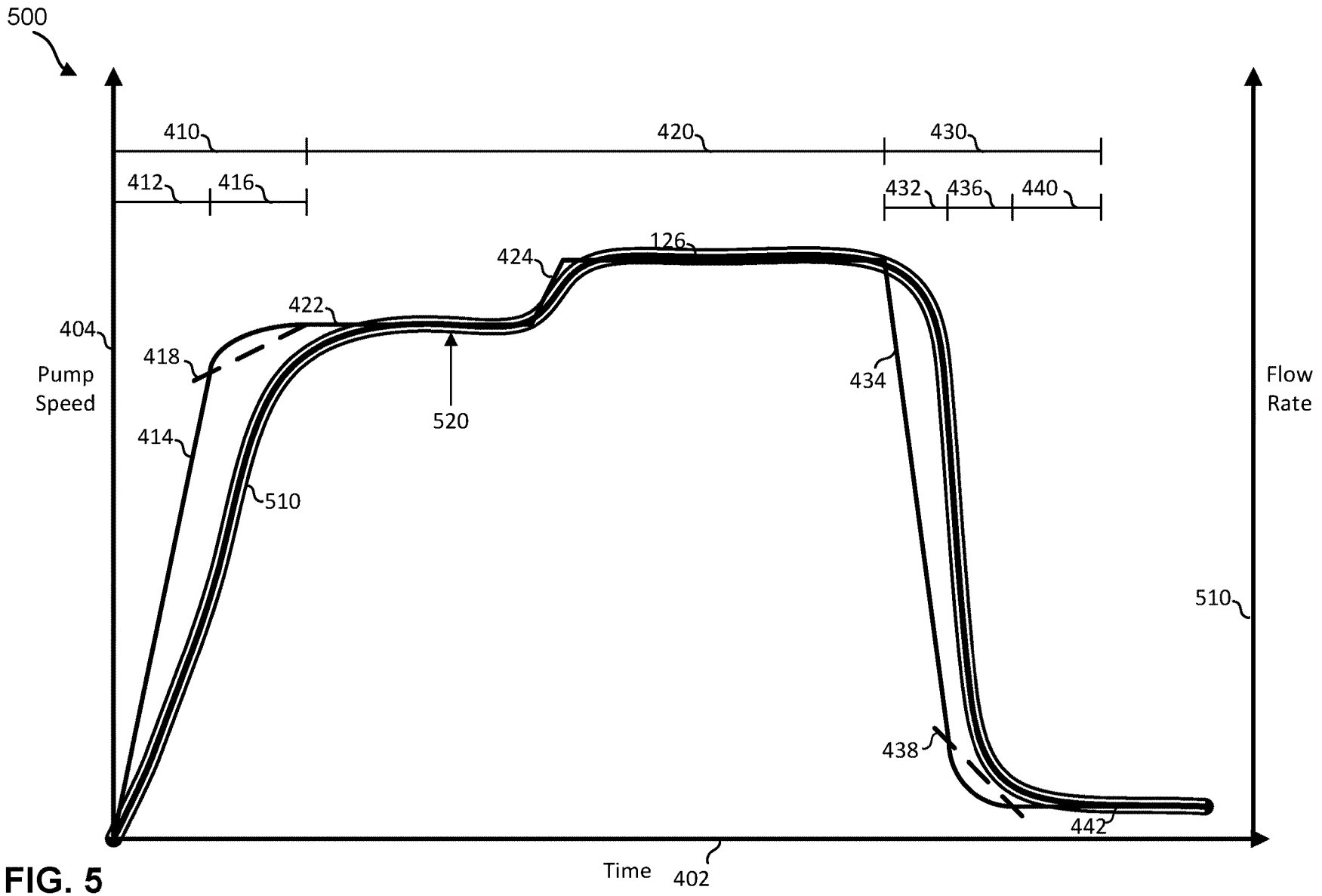
FIG. 5 is a diagram of an example flow rate produced by a pump operating according to the example pump motion profile of FIG. 4.

FIG. 5 is a diagram 500 of a flow rate 510 based on the motion profile 400. The flow rate 510 may generally follow the motion profile 400, with some latency for the flow rate 510 to respond to changes in speed. Additionally, the flow rate 510 may have greater variability and noise than the motor speed. In an aspect where the pump 110 is a peristaltic pump, the flow rate 510 may experience pulses as rollers move a volume of trapped fluid. As such, the flow rate 510 may move between an upper bound and lower bound near an average flow rate. In an aspect, the flow rate signal from the flow rate sensor 112 may be processed with a signal processor to determine an average flow rate from the noisy signal. Due to the latency and noise of the flow rate signal, during the acceleration phase 410 and the deceleration phase 430, the flow rate 510 may be difficult to measure, so constant feedback mechanisms such as a PID controller may not be effective. During the constant speed phase 420, the flow rate 510 may converge to a constant rate. The pump controller 160 may measure the flow rate 510 at a point 520 during the constant speed phase 420 to determine the adjustment 424. For example, the flow rate at point 520 may be compared to the predicted flow rate based on the mapping 300. The second constant speed 126 may be selected to compensate for any deviation between the flow rate 510 at the point 520 and the predicted flow rate. During the deceleration phase 430, the pump 110 may be controlled according to the pump motion profile 400. Again, the change to the flow rate 510 may lag behind the change to pump speed. During the constant speed portion 440, the pump 110 may operate at the constant speed 442 such that the total volume slowly increases. The pump motion profile 400 may be selected such that the constant speed portion 440 is relatively short. The pump 110 may be stopped when the total volume reaches the target volume.

Figure 6:
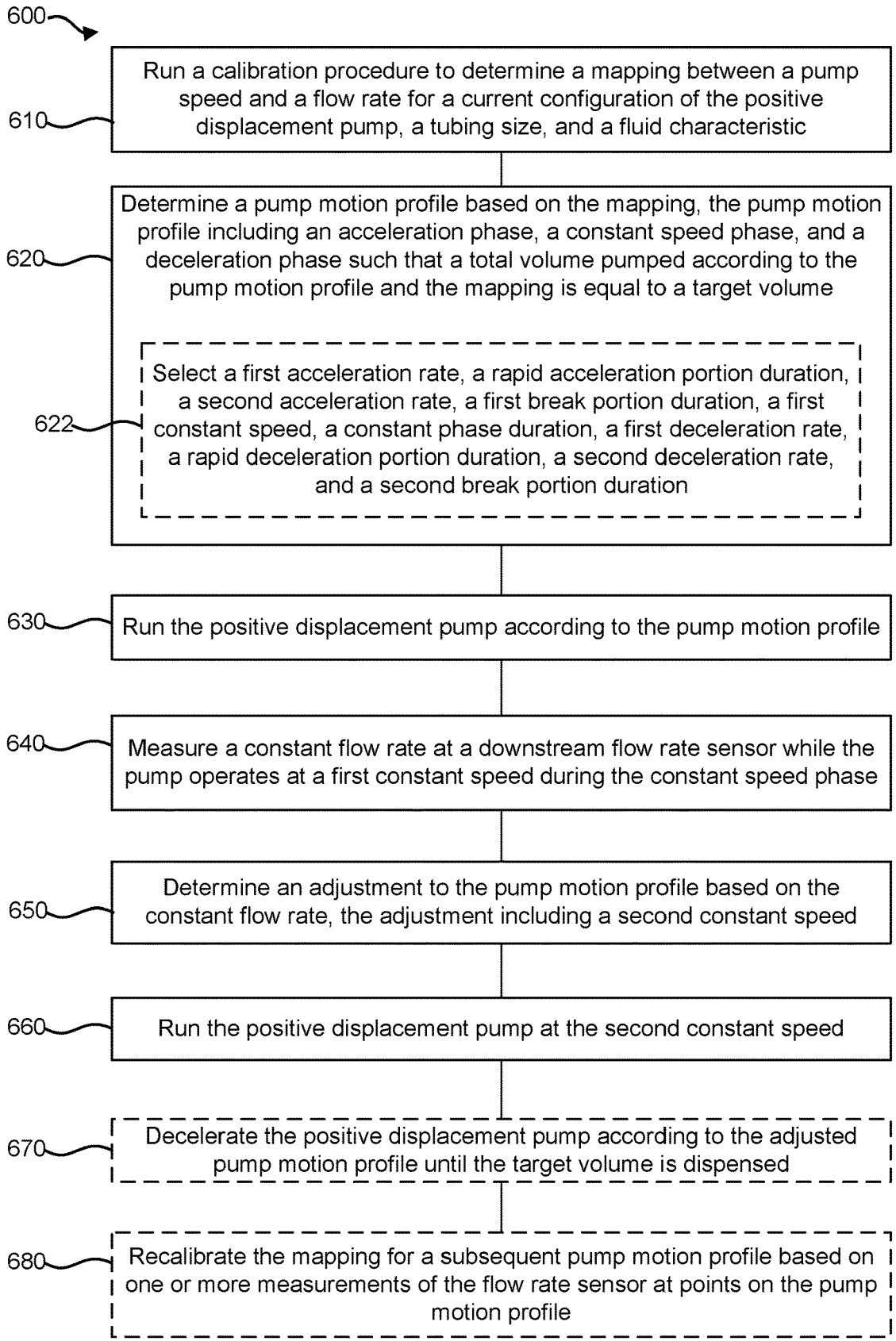
FIG. 6 is a flow diagram showing an example method of controlling a positive displacement pump, according to an aspect of the disclosure.

FIG. 6 is a flow diagram showing an example method 600 of controlling a positive displacement pump, in accordance with aspects of the present disclosure. The method 600 may be performed by the pump controller 160 of FIG. 2, for example. Optional blocks are shown with dashed lines.

In block 610, the method 600 may include running a calibration procedure to determine a mapping between a pump speed and a flow rate for a current configuration of the positive displacement pump, a tubing size, and a fluid characteristic. In an aspect, for example, as shown in FIG. 3, the calibration procedure may determine the mapping 300 including flow rate 320 at various pump speeds 310. During the calibration procedure, the flow rate 320 may be measured when the pump operates at a constant speed such that the flow rate signal has stabilized and is less noisy.

In block 620, the method 600 may include determining a pump motion profile 400 based on the mapping 300. The pump motion profile includes an acceleration phase 410, a constant speed phase 420, and a deceleration phase 430 such that a total volume pumped according to the pump motion profile and the mapping is equal to a target volume. In an aspect, for example, the profile generator 266 of the pump controller 260 may determine the pump profile 400 based on the mapping 300. In an aspect, for example, the block 620 may optionally include sub-block 622, in which the method may include selecting a first acceleration rate 414, a rapid acceleration portion 412 duration, second acceleration rate 418, a first break portion 416 duration, a first constant speed 422, a constant speed phase 420 duration, a first deceleration rate 434, a rapid deceleration portion 432 duration, a second deceleration rate 438, and a second break portion 436 duration. The first acceleration rate 414 may be based on a maximum acceleration rate for a configuration of the pump 110. For example, the pump 110 may accelerate from a complete stop to a maximum speed in approximately 300-400 milliseconds. The rapid acceleration portion 412 duration may be based on the first acceleration rate 414 and the first constant speed 422 (e.g., an amount of time to reach 90% of the first constant speed 422 at the first acceleration rate 414). The second acceleration rate 418 and first break portion 416 duration may be based on a variance and a latency in the flow rate. The first constant speed 422 may be set based on a maximum speed of the pump 110. For example, the first constant speed 422 may be approximately 95% of the maximum speed to allow for adjustment. The constant speed phase 420 duration may be based on the predicted flow rate for the first constant speed (e.g., a time to pump 90% of the total volume at the first constant speed). The first deceleration rate 434 may be based on a maximum deceleration rate of the pump 110. The rapid deceleration portion 432 duration may be based on a time to decelerate from the first constant speed 422 to the constant speed 442. The rapid deceleration portion 432 may be adjusted based on the second constant speed 426 during operation. The second deceleration rate 438 and the second break portion 436 duration may be based on the variance and the latency in the flow rate.

In block 630, the method 600 may include running the positive displacement pump according to the pump motion profile. In an aspect, for example, the motor controller 262 may run the positive displacement pump 110 according to the pump motion profile 400. For instance, the motor controller 262 may convert the pump speed 404 to a control signal (e.g., a pulse width modulated signal) for the time 402. The control signal may be provided to the drive motor 240.

In block 640, the method 600 may include measuring a constant flow rate at a downstream flow rate sensor while the pump operates at a first constant speed 422 during the constant speed phase 420. In an aspect, for example, the measurement component 268 may measure the constant flow rate based on a flow rate signal from the flow rate sensor 112. The measurement component 268 may include a signal processor that samples the flow rate signal and determines an average flow rate.

In block 650, the method 600 may include determining an adjustment 424 to the pump motion profile 400 based on the constant flow rate. In an aspect, for example, the adjustment component 270 may determine the adjustment 424. The adjustment 424 may include a second constant speed 126. For example, the second constant speed 126 may compensate for any deviation between a flow rate 510 at the point 520 and a predicted flow rate according to the mapping 300.

In block 660, the method 600 may include running the positive displacement pump 110 at the second constant speed 426. In an aspect, for example, the motor controller 262 may run the positive displacement pump 110 at the second constant speed 426 by providing a control signal based on the second constant speed 426 to the drive motor 240.

In block 670, the method 600 may include decelerating the positive displacement pump 110 according to the adjusted pump motion profile until the target volume is dispensed. In an aspect, for example, the motor controller 262 may decelerate the positive displacement pump 110 according to the adjusted pump motion profile by providing a control signal based on the deceleration phase 430 to the drive motor 240. The adjusted pump motion profile may include the adjustment 424 such that the deceleration phase 430 starts at the second constant speed 426. Additionally, the measurement component 268 may determine when the target volume is dispensed. For example, the measurement component 268 may integrate the measured flow rate 510 over the time 402 of the pump motion profile 400. Accordingly, the measurement component 268 may also measure a current total dispensed volume. The measurement component 268 may generate a stop signal to the motor controller 262 when the target volume is dispensed.

In block 680, the method 600 may optionally include recalibrating the mapping for a subsequent pump motion profile based on one or more measurements of the flow rate sensor at points on the pump motion profile. For example, the calibration component 264 may recalibrate the mapping 300 based on one or more measurements of the flow rate 510 (e.g., at point 520). In some implementations, the block 680 may be performed when a difference between the measurement at point 520 and the predicted flow rate according to the mapping 300 is greater than a threshold.

Figure 7:
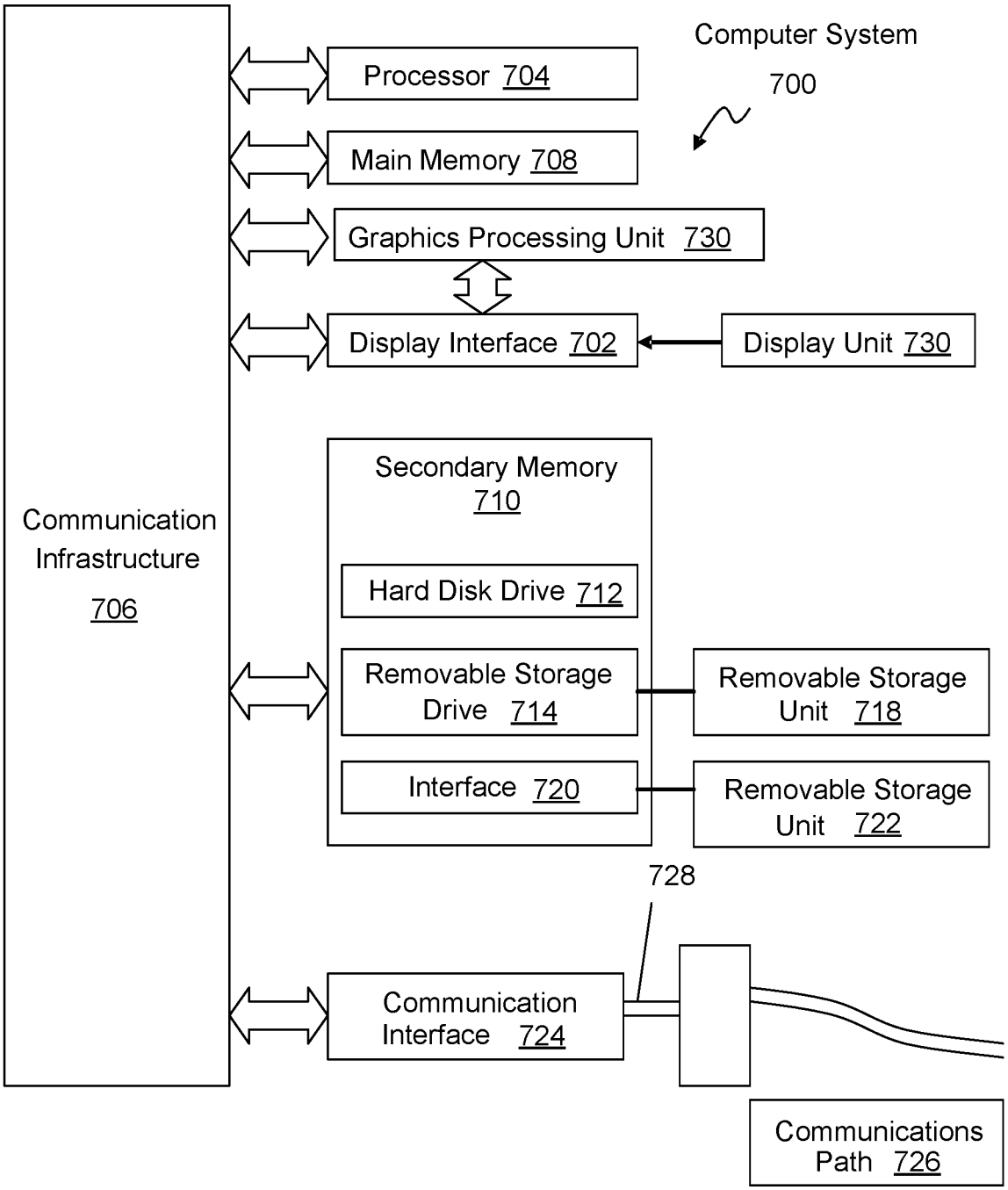
FIG. 7 presents an exemplary system diagram of various hardware components and other features, for use in accordance with aspects of the present disclosure.

Aspects of the present disclosure may be implemented using hardware, software, or a combination thereof and may be implemented in one or more computer systems or other processing systems. In one aspect, the disclosure is directed toward one or more computer systems capable of carrying out the functionality described herein. FIG. 7 presents an example system diagram of various hardware components and other features that may be used in accordance with aspects of the present disclosure. Aspects of the present disclosure may be implemented using hardware, software, or a combination thereof and may be implemented in one or more computer systems or other processing systems. In one example variation, aspects of the disclosure are directed toward one or more computer systems capable of carrying out the functionality described herein. An example of such a computer system 700 is shown in FIG. 7.

Computer system 700 includes one or more processors, such as processor 704. The processor 704 is connected to a communication infrastructure 706 (e.g., a communications bus, cross-over bar, or network). Various software aspects are described in terms of this example computer system. After reading this description, it will become apparent to a person skilled in the relevant art(s) how to implement aspects of the disclosure using other computer systems and/or architectures.

Computer system 700 may include a display interface 702 that forwards graphics, text, and other data from the communication infrastructure 706 (or from a frame buffer not shown) for display on a display unit 730. Computer system 700 also includes a main memory 708, preferably random access memory (RAM), and may also include a secondary memory 710. The secondary memory 710 may include, for example, a hard disk drive 712 and/or a removable storage drive 714, representing a floppy disk drive, a magnetic tape drive, an optical disk drive, etc. The removable storage drive 714 reads from and/or writes to a removable storage unit 718 in a well-known manner. Removable storage unit 718, represents a floppy disk, magnetic tape, optical disk, etc., which is read by and written to removable storage drive 714. As will be appreciated, the removable storage unit 718 includes a computer usable storage medium having stored therein computer software and/or data.

In alternative aspects, secondary memory 710 may include other similar devices for allowing computer programs or other instructions to be loaded into computer system 700. Such devices may include, for example, a removable storage unit 722 and an interface 720. Examples of such may include a program cartridge and cartridge interface (such as that found in video game devices), a removable memory chip (such as an erasable programmable read only memory (EPROM), or programmable read only memory (PROM)) and associated socket, and other removable storage units 722 and interfaces 720, which allow software and data to be transferred from the removable storage unit 722 to computer system 700.

Computer system 700 may also include a communications interface 724. Communications interface 724 allows software and data to be transferred between computer system 700 and external devices. Examples of communications interface 724 may include a modem, a network interface (such as an Ethernet card), a communications port, a Personal Computer Memory Card International Association (PCMCIA) slot and card, etc. Software and data transferred via communications interface 724 are in the form of signals 728, which may be electronic, electromagnetic, optical or other signals capable of being received by communications interface 724. These signals 728 are provided to communications interface 724 via a communications path (e.g., channel) 726. This path 726 carries signals 728 and may be implemented using wire or cable, fiber optics, a telephone line, a cellular link, a radio frequency (RF) link and/or other communications channels. In this document, the terms "computer program medium" and "computer usable medium" are used to refer generally to media such as a removable storage drive 714, a hard disk installed in hard disk drive 712, and signals 728. These computer program products provide software to the computer system 700. Aspects of the disclosure are directed to such computer program products.

Computer programs (also referred to as computer control logic) are stored in main memory 708 and/or secondary memory 710. Computer programs may also be received via communications interface 724. Such computer programs, when executed, enable the computer system 700 to perform various features in accordance with aspects of the present disclosure, as discussed herein. In particular, the computer programs, when executed, enable the processor 704 to perform such features. Accordingly, such computer programs represent controllers of the computer system 700.

In variations where aspects of the disclosure are implemented using software, the software may be stored in a computer program product and loaded into computer system 700 using removable storage drive 714, hard disk drive 712, or communications interface 720. The control logic (software), when executed by the processor 704, causes the processor 704 to perform the functions in accordance with aspects of the disclosure as described herein. In another variation, aspects are implemented primarily in hardware using, for example, hardware components, such as application specific integrated circuits (ASICs). Implementation of the hardware state machine so as to perform the functions described herein will be apparent to persons skilled in the relevant art(s).

In yet another example variation, aspects of the disclosure are implemented using a combination of both hardware and software.

Figure 8:
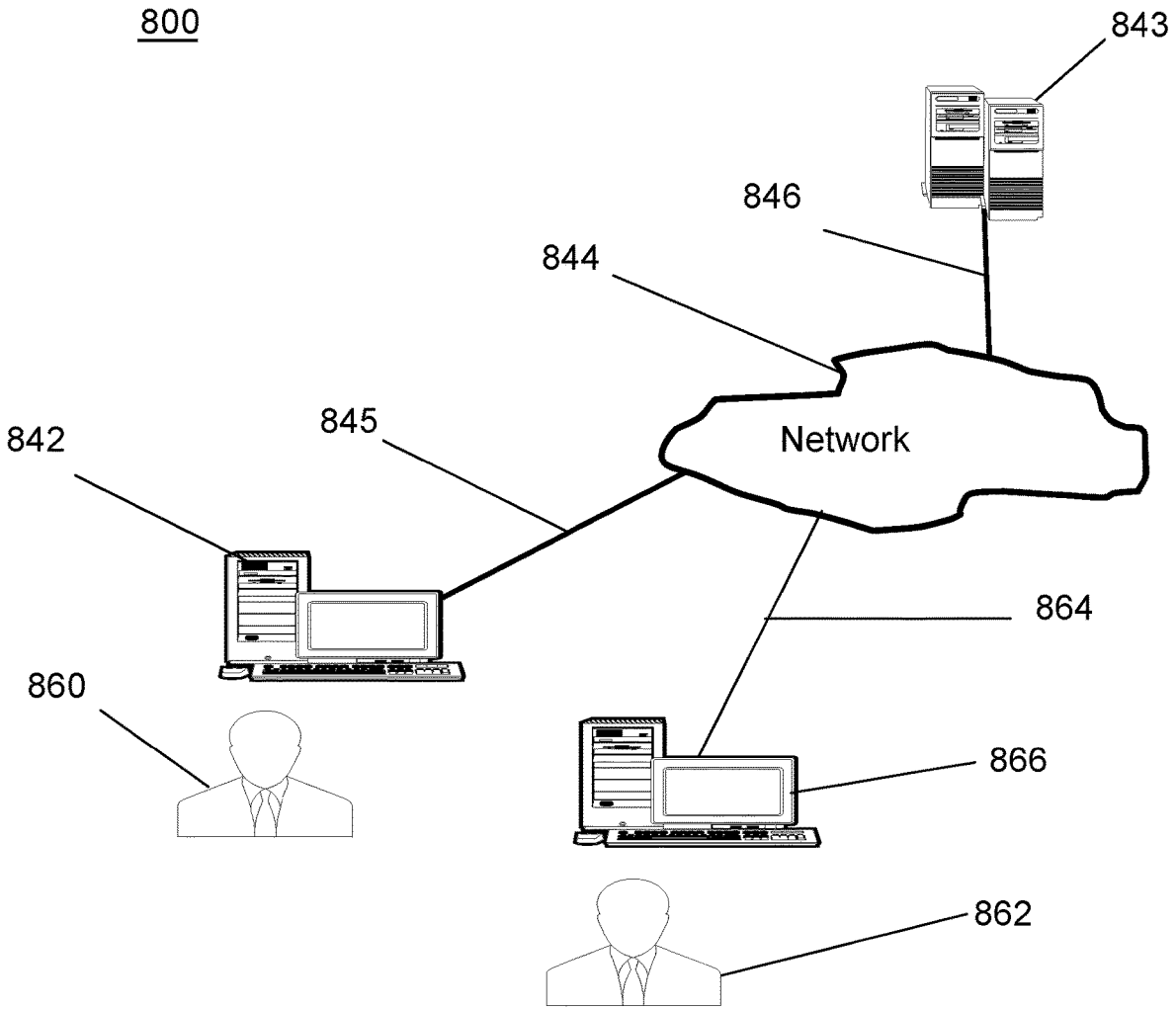
FIG. 8 is a block diagram of various exemplary system components, for use in accordance with aspects of the present disclosure

FIG. 8 is a block diagram of various example system components (e.g., on a network) that may be used in accordance with aspects of the present disclosure. The system 800 may include one or more accessors 860, 862 (also referred to interchangeably herein as one or more "users") and one or more terminals 842, 866. In one aspect, data for use in accordance with aspects of the present disclosure may, for example, be input and/or accessed by accessors 860, 862 via terminals 842, 866, such as personal computers (PCs), minicomputers, mainframe computers, microcomputers, telephonic devices, or wireless devices, such as personal digital assistants ("PDAs") or a hand-held wireless devices coupled to a server 843, such as a PC, minicomputer, mainframe computer, microcomputer, or other device having a processor and a repository for data and/or connection to a repository for data, via, for example, a network 844, such as the Internet or an intranet, and couplings 845, 846, 864. The couplings 845, 846, 864 include, for example, wired, wireless, or fiber optic links. In another example variation, the method and system in accordance with aspects of the present disclosure operate in a stand-alone environment, such as on a single terminal.

The aspects of the disclosure discussed herein may also be described and implemented in the context of computer-readable storage medium storing computer-executable instructions. Computer-readable storage media includes computer storage media and communication media. For example, flash memory drives, digital versatile discs (DVDs), compact discs (CDs), floppy disks, and tape cassettes. Computer-readable storage media may include volatile and nonvolatile, removable and non-removable media implemented in any method or technology for storage of information such as computer readable instructions, data structures, modules or other data.

This written description uses examples to disclose aspects of the present disclosure, including the preferred embodiments, and also to enable any person skilled in the art to practice the aspects thereof, including making and using any devices or systems and performing any incorporated methods. The patentable scope of these aspects is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims. Aspects from the various embodiments described, as well as other known equivalents for each such aspect, can be mixed and matched by one of ordinary skill in the art to construct additional embodiments and techniques in accordance with principles of this application.

The invention claimed is:

1. A method of controlling a peristaltic pump to obtain a predetermined target volume, comprising:

running a calibration procedure to determine a mapping between a pump speed and a flow rate for a current configuration of the positive displacement pump, a tubing size, and a fluid characteristic;

determining a pump motion profile based on the mapping associated with the target volume, wherein the pump motion profile includes an initial acceleration phase, a constant speed phase following the acceleration phase, and a deceleration phase following the constant speed phase such that a total volume pumped according to the pump motion profile and the mapping is equal to the target volume, wherein the time duration of the acceleration phase is less than the time duration of the constant speed phase;

running the peristaltic pump according to the pump motion profile including accelerating the pump based on a first acceleration rate to a first constant speed;

measuring a constant flow rate at a downstream flow rate sensor while the pump operates at a first constant speed during the first constant speed phase;

determining an adjustment to the pump motion profile based on the constant flow rate measured by the downstream sensor, the adjustment including a second constant speed that is greater than the first constant speed;

accelerating the pump speed to the second constant speed based on the determined adjustment;

running the peristaltic pump at the second constant speed; and at a time subsequent to running the peristaltic pump at the second constant speed, decelerating the peristaltic pump according to the adjusted pump motion profile until the target volume is dispensed.

2. The method of claim 1, wherein the first acceleration phase includes a rapid acceleration portion having a first acceleration rate and a first break portion having a second acceleration rate that is less than the first acceleration rate.

3. The method of claim 1, wherein the adjustment is a single adjustment of the first constant speed during the pump motion profile.

4. The method of claim 1, wherein the deceleration phase includes a rapid deceleration portion having a first deceleration rate, a second break portion having a second deceleration rate that is less than the first deceleration rate, and a constant portion.

5. The method of claim 4, wherein the constant portion has a constant speed based on a target precision.

6. The method of claim 1, further comprising recalibrating the mapping for a subsequent pump motion profile based on one or more measurements of the flow rate sensor at points on the pump motion profile.

7. The method of claim 1, wherein determining the pump motion profile based on the mapping comprises selecting a first acceleration rate, a rapid acceleration portion duration, second acceleration rate, a first break portion duration, a first constant speed, a constant speed phase duration, a first deceleration rate, a rapid deceleration portion duration, a second deceleration rate, and a second break portion duration.

8. A system of controlling a peristaltic pump to obtain a predetermined target volume, comprising:

the peristaltic pump configured to pump a fluid through a tube;

a flow sensor configured to measure a flow rate of the fluid in the tube downstream from the peristaltic pump; and a pump controller configured to:

run a calibration procedure to determine a mapping between a pump speed and a flow rate for a current configuration of the peristaltic pump, a tubing size, and a fluid characteristic;

determine a pump motion profile based on the mapping associated with the target volume, wherein the pump motion profile includes an initial acceleration phase, a constant speed phase following the acceleration phase, and a deceleration phase following the constant speed phase such that a total volume pumped according to the pump motion profile and the mapping is equal to the target volume, wherein the time duration of the acceleration phase is less than the time duration of the constant speed phase;

run the peristaltic pump according to the pump motion profile including accelerating the pump based on a first acceleration rate to a first constant speed;

measure a constant flow rate at a downstream flow rate sensor while the pump operates at a first constant speed during the first constant speed phase;

determine an adjustment to the pump motion profile based on the constant flow rate measured by the downstream sensor, the adjustment including a second constant speed that is greater than the first constant speed;

accelerate the pump speed to the second constant speed based on the determined adjustment;

run the peristaltic pump at the second constant speed; and at a time subsequent to running the peristaltic pump at the second constant speed, decelerate the peristaltic pump according to the adjusted pump motion profile until the target volume is dispensed.

9. The system of claim 8, wherein the first acceleration phase includes a rapid acceleration portion having a first acceleration rate and a first break portion having a second acceleration rate that is less than the first acceleration rate.

10. The system of claim 8, wherein the adjustment is a single adjustment of the first constant speed during the pump motion profile.

11. The system of claim 8, wherein the deceleration phase includes a rapid deceleration portion having a first deceleration rate, a second break portion having a second deceleration rate that is less than the first deceleration rate, and a constant portion.

12. The system of claim 11, wherein the constant portion has a constant speed based on a target precision.

13. The system of claim 8, wherein the pump controller is configured to recalibrate the mapping for a subsequent pump motion profile based on one or more measurements of the flow rate sensor at points on the pump motion profile.

14. The system of claim 8, wherein the pump controller is configured to select a first acceleration rate, a rapid acceleration portion duration, second acceleration rate, a first break portion duration, a first constant speed, a constant speed phase duration, a first deceleration rate, a rapid deceleration portion duration, a second deceleration rate, and a second break portion duration for the pump motion profile.

15. A peristaltic pump, comprising:

a pumphead configured to pump a fluid through a tube;

a flow sensor configured to measure a flow rate of the fluid in the tube downstream from the pumphead; and a pump controller configured to:

run a calibration procedure to determine a mapping between a pump speed and a flow rate for a current configuration of the peristaltic pump, a tubing size, and a fluid characteristic;

determine a pump motion profile based on the mapping to obtain a predetermined target volume, wherein the pump motion profile includes an initial acceleration phase, a constant speed phase following the acceleration phase, and a deceleration phase following the constant speed phase such that a total volume pumped according to the pump motion profile and the mapping is equal to the target volume, wherein the time duration of the acceleration phase is less than the time duration of the constant speed phase;

run the peristaltic pump according to the pump motion profile including accelerating the pump based on a first acceleration rate to a first constant speed;

measure a constant flow rate at a downstream flow rate sensor while the pump operates at a first constant speed during the first constant speed phase;

determine an adjustment to the pump motion profile based on the constant flow rate measured by the downstream sensor, the adjustment including a second constant speed that is greater than the first constant speed;

run the peristaltic pump at the second constant speed; and at a time subsequent to running the peristaltic pump at the second constant speed, decelerate the peristaltic pump according to the adjusted pump motion profile until the target volume is dispensed.

16. The positive displacement pump of claim 15, wherein the first acceleration phase includes a rapid acceleration portion having a first acceleration rate and a first break portion having a second acceleration rate that is less than the first acceleration rate.

17. The positive displacement pump of claim 15, wherein the adjustment is a single adjustment of the first constant speed during the pump motion profile.

18. The positive displacement pump of claim 15, wherein the deceleration phase includes a rapid deceleration portion having a first deceleration rate, a second break portion having a second deceleration rate that is less than the first deceleration rate, and a constant portion.

19. The positive displacement pump of claim 18, wherein the constant portion has a constant speed based on a target precision.

20. The positive displacement pump of claim 15, wherein the pump controller is configured to recalibrate the mapping for a subsequent pump motion profile based on one or more measurements of the flow rate sensor at points on the pump motion profile.

21. The positive displacement pump of claim 15, wherein the pump controller is configured to select a first acceleration rate, a rapid acceleration portion duration, second acceleration rate, a first break portion duration, a first constant speed, a constant speed phase duration, a first deceleration rate, a rapid deceleration portion duration, a second deceleration rate, and a second break portion duration for the pump motion profile.

* * * * *